US006656348B2

(12) United States Patent
Dassori et al.

(10) Patent No.: US 6,656,348 B2
(45) Date of Patent: Dec. 2, 2003

(54) HYDROPROCESSING PROCESS

(75) Inventors: Carlos Gustavo Dassori, Miranda (VE); Nancy Fernandez, Caracas (VE); Rosa Arteca, Caracas (VE); Carlos Castillo, Miranda (VE)

(73) Assignee: Intevep, S.A. (VE)

( * ) Notice: Subject to any disclaimer, the term of this patent is extended or adjusted under 35 U.S.C. 154(b) by 0 days.

(21) Appl. No.: 09/960,442

(22) Filed: Sep. 24, 2001

(65) Prior Publication Data

US 2002/0166796 A1 Nov. 14, 2002

Related U.S. Application Data

(63) Continuation-in-part of application No. 09/797,448, filed on Mar. 1, 2001.

(51) Int. Cl.[7] ..... C01G 45/00; C01G 45/04
(52) U.S. Cl. ..... 208/210; 208/213
(58) Field of Search ..... 208/210, 213, 208/227

(56) References Cited

U.S. PATENT DOCUMENTS

| | | | | |
|---|---|---|---|---|
| 3,809,664 A | | 5/1974 | Fanta et al. | |
| 4,016,070 A | | 4/1977 | Christman et al. | |
| 4,431,525 A | | 2/1984 | Hensley, Jr. et al. | |
| 4,877,647 A | | 10/1989 | Klabunde | |
| 5,110,444 A | | 5/1992 | Haun et al. | |
| 5,183,556 A | | 2/1993 | Reilly et al. | |
| 5,292,428 A | | 3/1994 | Harrison et al. | |
| 5,705,052 A | | 1/1998 | Gupta | |
| 5,720,872 A | | 2/1998 | Gupta | |
| 5,759,939 A | | 6/1998 | Klabunde et al. | |
| 5,779,992 A | | 7/1998 | Higashi | |
| 5,925,239 A | | 7/1999 | Klein et al. | |
| 5,928,498 A | | 7/1999 | McVicker et al. | |
| 5,935,420 A | | 8/1999 | Baird, Jr. et al. | |
| 5,939,031 A | | 8/1999 | Ellis et al. | |
| 5,968,346 A | | 10/1999 | Jung et al. | |
| 5,985,131 A | | 11/1999 | Gupta et al. | |
| 5,985,136 A | | 11/1999 | Brignac et al. | |
| 6,007,787 A | | 12/1999 | Gupta et al. | |
| 6,017,442 A | | 1/2000 | Wu et al. | |
| 6,017,443 A | | 1/2000 | Buchanan | |
| 6,054,041 A | * | 4/2000 | Ellis et al. | 208/210 |
| 6,087,294 A | | 7/2000 | Klabunde et al. | |

FOREIGN PATENT DOCUMENTS

| | | |
|---|---|---|
| EP | 0793701 | 9/1997 |
| EP | 0 870 817 | 10/1998 |
| EP | 1 236 788 | 9/2002 |

* cited by examiner

*Primary Examiner*—Thuan D. Dang
(74) *Attorney, Agent, or Firm*—Bachman & LaPointe

(57) ABSTRACT

A process for hydroprocessing a hydrocarbon feed with a flow rate of hydrogen-containing gas and a volume of catalyst, includes providing a hydrocarbon feed; feeding the hydrocarbon feed and a first portion of the hydrogen-containing gas flow rate cocurrently to a first hydroprocessing zone containing a first portion of the catalyst so as to provide a first hydrocarbon product; providing an additional hydroprocessing zone containing a remainder of the catalyst; feeding the first hydrocarbon product cocurrently with a remainder of the hydrogen-containing gas flow rate to the additional hydroprocessing zone so as to provide a final hydrocarbon product, wherein the first portion of the hydrogen-containing gas flow rate is between about 30 and about 80% vol. of the hydrogen-containing gas flow rate, and the first portion of the catalyst is between about 30 and about 70% wt. of the volume of catalyst.

12 Claims, 11 Drawing Sheets

HYDROPROCESSING PROCESS

CROSS-REFERENCE TO RELATED APPLICATION

This application is a Continuation-In-Part of co-pending U.S. patent application Ser. No. 09/797,448, filed Mar. 1, 2001 allowed.

BACKGROUND OF THE INVENTION

The invention relates to a deep hydroprocessing process and, more particularly, to a process for advantageously removing substantial amounts of contaminant such as sulfur from hydrocarbon feedstocks.

A persistent problem in the art of petroleum refining is to reach acceptably low levels of sulfur content and other contaminants.

A large portion of the world's hydrocarbon reserves contain sulfur, and removal of this sulfur is critical in order to provide acceptable fuels.

Government agencies are currently formulating new regulations which will require sulfur content in fuels to be substantially lower than current practice. It is expected that such regulations will require sulfur content of less than 15 wppm.

A number of processes have been attempted for use in removing sulfur, one of which is hydrodesulfurization, wherein a hydrogen flow is exposed to the feedstock in the presence of a suitable catalyst so that sulfur compounds react to produce a volatile product, hydrogen sulfide.

Such processes do provide substantial reduction in sulfur in the feed. However, existing facilities do not readily provide for reduction of sulfur content to desired levels. Known hydrodesulfurization methods include cocurrent processes, wherein hydrogen and hydrocarbon feed are fed through a reactor or zone in the same direction, and countercurrent processes wherein hydrocarbon is fed in one direction and gas is fed in the other direction.

Known cocurrent processes do not provide acceptable levels of sulfur removal for acceptable catalyst volumes, and countercurrent processes typically experience difficulty in reactor flooding which occurs when the desired amount of gas flow to the reactor prevents flow of the hydrocarbon in the counter direction. Reduction of gas flow to address flooding reduces the effectiveness of countercurrent hydrodesulfurization processes.

Another potential problem with countercurrent processes is that adiabatic countercurrent processes may operate at temperatures much higher than adiabatic cocurrent processes, and this temperature is detrimental to hydrodesulfurization and other catalysts used in the process.

Based upon the foregoing, it is clear that the need remains for an advantageous process for removal of sulfur to levels which will meet the expected regulations on hydrocarbons for use as fuel.

It is therefore the primary object of the present invention to provide a process whereby sulfur content is advantageously reduced to less than or equal to about 10 wppm.

It is a further object of the present invention to provide a process which can be carried out without substantially increasing the equipment size and space occupied by same in current hydrodesulfurization systems.

It is another object of the present invention to provide a hydrodesulfurization system which accomplishes the aforesaid objectives.

It is still another object of the present invention to provide a simple processing scheme that improves sulfur removal as compared to conventional processes.

Other objects and advantages of the present invention will appear hereinbelow.

SUMMARY OF THE INVENTION

In accordance with the present invention, the foregoing objects and advantages have been readily attained.

In accordance with the invention, a process is provided for hydroprocessing a hydrocarbon feedstock with a known flow rate of hydrogen-containing gas and a volume of catalyst, which process comprises the steps of providing a hydrocarbon feed having an initial characteristic; feeding said hydrocarbon feed and a first portion of said hydrogen-containing gas cocurrently to a first hydroprocessing zone containing a first portion of said catalyst so as to provide a first hydrocarbon product; providing an additional hydroprocessing zone containing a remainder of said catalyst; feeding said first hydrocarbon product cocurrently with a remainder of said hydrogen-containing gas to said additional hydroprocessing zone so as to provide a final hydrocarbon product having a final characteristic which is improved as compared to said initial characteristic, wherein said first portion of said hydrogen-containing gas is between about 30 and about 80% vol. of said known flow rate of said hydrogen-containing gas, and said first portion of said catalyst is between about 30 and about 70% wt. of said volume of catalyst.

Still further according to the invention, a system is provided for hydroprocessing a hydrocarbon feed with a known flow rate of hydrogen-containing gas and a volume of hydroprocessing catalyst, which system comprises a first hydroprocessing zone containing a first portion of said hydroprocessing catalyst and having an inlet for cocurrently receiving a hydrocarbon feed and a first portion of said known flow rate of hydrogen-containing gas; and an additional hydroprocessing zone containing a remainder of said hydroprocessing catalyst and having an inlet for cocurrently receiving a hydrocarbon product from said first hydroprocessing zone and a remainder of said hydrogen-containing gas, wherein said first portion of said hydroprocessing catalyst is between about 30 and about 70% wt. of said volume of said hydroprocessing catalyst.

The process and system of the present invention are particularly well suited for use in treating Diesel, gasoil and other distillate feedstocks to reduce sulfur and also for use in treating naphtha and like feedstocks as well, and provide excellent results as compared to conventional processes using a single reactor zone.

BRIEF DESCRIPTION OF THE DRAWINGS

A detailed description of preferred embodiments of the present invention follows, with reference to the attached drawings, wherein.

DETAILED DESCRIPTION

Figure 1:
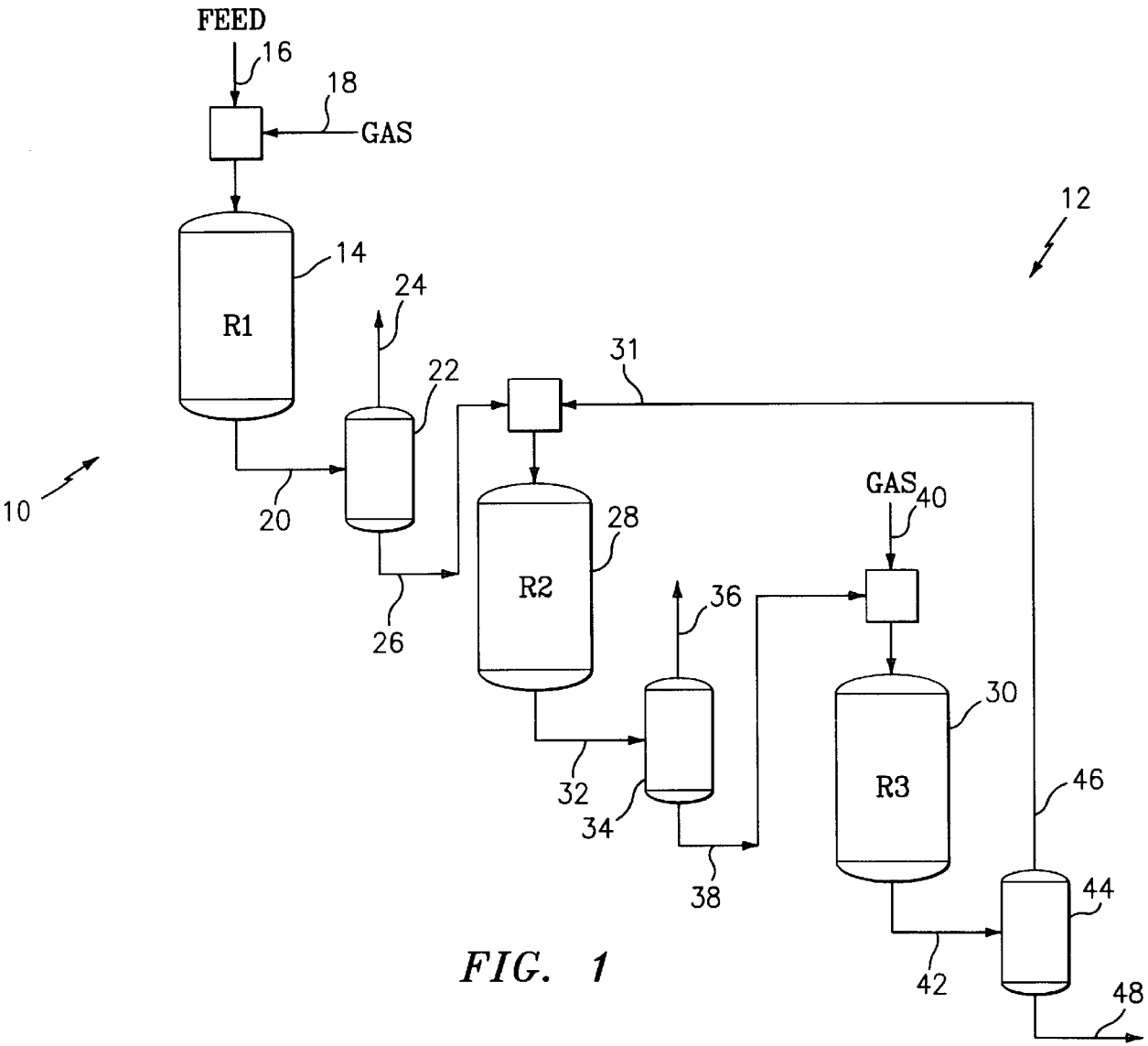
FIG. 1 schematically illustrates a process and system in accordance with the present invention.

In accordance with the present invention, a hydroprocessing process and system are provided for removal of contaminants, especially sulfur from a hydrocarbon feed such as Diesel, gasoil, naphtha and the like. A particularly advantageous aspect of the present invention is hydrodesulfurization, and the following detailed description is given as to a hydrodesulfurization process.

The process and system of the present invention advantageously allow for reduction of sulfur content to less than or equal to about 50 wppm, more preferably to less than or equal to about 10 wppm, which is expected to satisfy regulations currently proposed by various Government agencies, without requiring substantial expense for new equipment, additional reactors, and the like.

In accordance with one aspect of the present invention, a process is provided which combines a single cocurrently operated hydrodesulfurization reactor with a second stage including a plurality of hydrodesulfurization reactors to obtain a desired result. As will be further discussed below, the second stage includes a plurality of additional hydrodesulfurization reactors or zones and is operated in a globally countercurrent, yet locally cocurrent, mode. This means that when considered on the basis of the reactors overall, the hydrocarbon and hydrogen-containing gas are fed in opposite directions. However, each reactor or zone is coupled so as to flow the hydrocarbon and hydrogen-containing gas in a cocurrent direction within that reactor, thereby providing the benefits of globally countercurrent flow, while avoiding the flooding problems which might be experienced with local countercurrent flow through a reactor or zone.

The reactors within the second stage are arranged such that the hydrocarbon feedstock travels from a first reactor to a last or final reactor, and the hydrogen gas phase travels from the last reactor to the first reactor. In the following detailed description, the group of reactors that are utilized in the second zone are referred to as including a final reactor, from which the finally treated hydrocarbon exits, and upstream reactors which are upstream of the final reactor when taken in connection with the flow of hydrocarbon. Thus, in FIG. 1, reactor 28 is upstream from reactor 30 when considered in light of the direction of hydrocarbon flow, and in FIG. 2, reactor 52 is upstream of reactor 54, and reactor 50 is upstream of both reactors 52 and 54, also when considered in connection with the direction of hydrocarbon flow. Thus, as used herein, an upstream reactor is a reactor which is upstream as it relates to hydrocarbon flow.

In accordance with the present invention, the hydrodesulfurization steps to be carried out are accomplished by contacting or mixing the hydrocarbon feed containing sulfur with a hydrogen gas-containing phase in the presence of a hydrodesulfurization catalyst and at hydrodesulfurization conditions whereby sulfur species within the hydrocarbon convert to hydrogen sulfide gas which remains substantially with the hydrogen gas phase upon separation of liquid and gas phases. Suitable catalyst for use in hydrodesulfurization processes are well known to a person of ordinary skill in the art, and selection of the particular catalyst forms no part of the present invention. Of course, such catalysts could include a wide variety of hydroprocessing catalysts within the broad scope of the present invention.

In connection with the gas phase, suitable gas contains hydrogen as desired for the hydroprocessing reaction. This gas may be substantially pure hydrogen or may contain other gases, so long as the desired hydrogen is present for the desired reaction. Thus, as used herein, hydrogen-containing gas includes substantially pure hydrogen gas and other hydrogen-containing streams.

Turning now to FIG. 1, a hydrodesulfurization process in accordance with the present invention is schematically illustrated.

As shown, the process is carried out in a first stage 10 and a second stage 12, so as to provide a final hydrocarbon product having acceptably low content of sulfur.

As shown, first stage 10 is carried out utilizing a first reactor 14 to which is fed a hydrocarbon feed 16 containing an initial amount of sulfur. Feed 16 is combined with a hydrogen-containing gas 18 and fed cocurrently through reactor 14 such that cocurrent flow of hydrocarbon feed 16 and gas 18 in the presence of hydrodesulfurization catalyst and conditions converts sulfur species within the hydrocarbon into hydrogen sulfide within the product 20 of reactor 14. Product 20 is fed to a liquid gas separator 22 where a predominately hydrogen and hydrogen sulfide containing gas phase 24 is separated from an intermediate product 26. Intermediate product 26 has a reduced sulfur content as compared to hydrocarbon feed 16, and is fed to second stage 12 in accordance with the present invention for further treatment to reduce sulfur content.

As shown, second stage 12 preferably includes a plurality of additional reactors 28, 30, which are connected in series for treating intermediate product 26 as will be further discussed below. As shown, reactor 28 preferably receives intermediate hydrocarbon feed 26 which is mixed with a recycled hydrogen gas 31 and fed cocurrently through reactor 28. Product 32 from reactor 28 is then fed to a liquid gas separator 34 for separation of a predominately hydrogen and hydrogen sulfide containing gas phase 36 and a further treated liquid hydrocarbon product 38 having a sulfur content still further reduced as compared to intermediate hydrocarbon feed 26. Hydrocarbon feed 38 is then fed to reactor 30, combined with an additional hydrogen feed 40 and fed cocurrently with hydrogen feed 40 through reactor 30 to accomplish still further hydrodesulfurization and produce a final product 42 which is fed to a separator 44 for separation of a gas phase 46 containing hydrogen and hydrogen sulfide as major components, and a final liquid hydrocarbon product 48 having substantially reduced sulfur content.

In accordance with the present invention, gas phase 46 is recycled for use as recycled gas 31 such that gas flowing through the reactors of second stage 12 is globally countercurrent to the flow of hydrocarbon through same. Considering the flow of hydrocarbon from reactor 28 to reactor 30, it is readily apparent that reactor 28 is an upstream reactor and reactor 30 is a final reactor of second stage 12. It should of course be appreciated that additional upstream reactors could be included in second stage 12 if desired, and that second stage 12 preferably includes at least two reactors 28, 30 as shown in the drawings. However, it is a particular advantage of the present invention that excellent results are obtained utilizing the first and second stages as described above with a like number of reactors as are currently used in conventional processes, thereby avoiding the need for additional equipment and space.

It should also be appreciated that although FIG. 1 shows reactors 14, 28 and 30 as separate and discrete reactors, the process of the present invention could likewise be carried out by defining different zones within a collectively arranged reactor, so long as the zones are operated with flow of feed and gas as described above for the first and second stages, with local cocurrent flow through each zone of both stages and globally countercurrent flow through the at least two zones of second stage 12.

Figure 2:
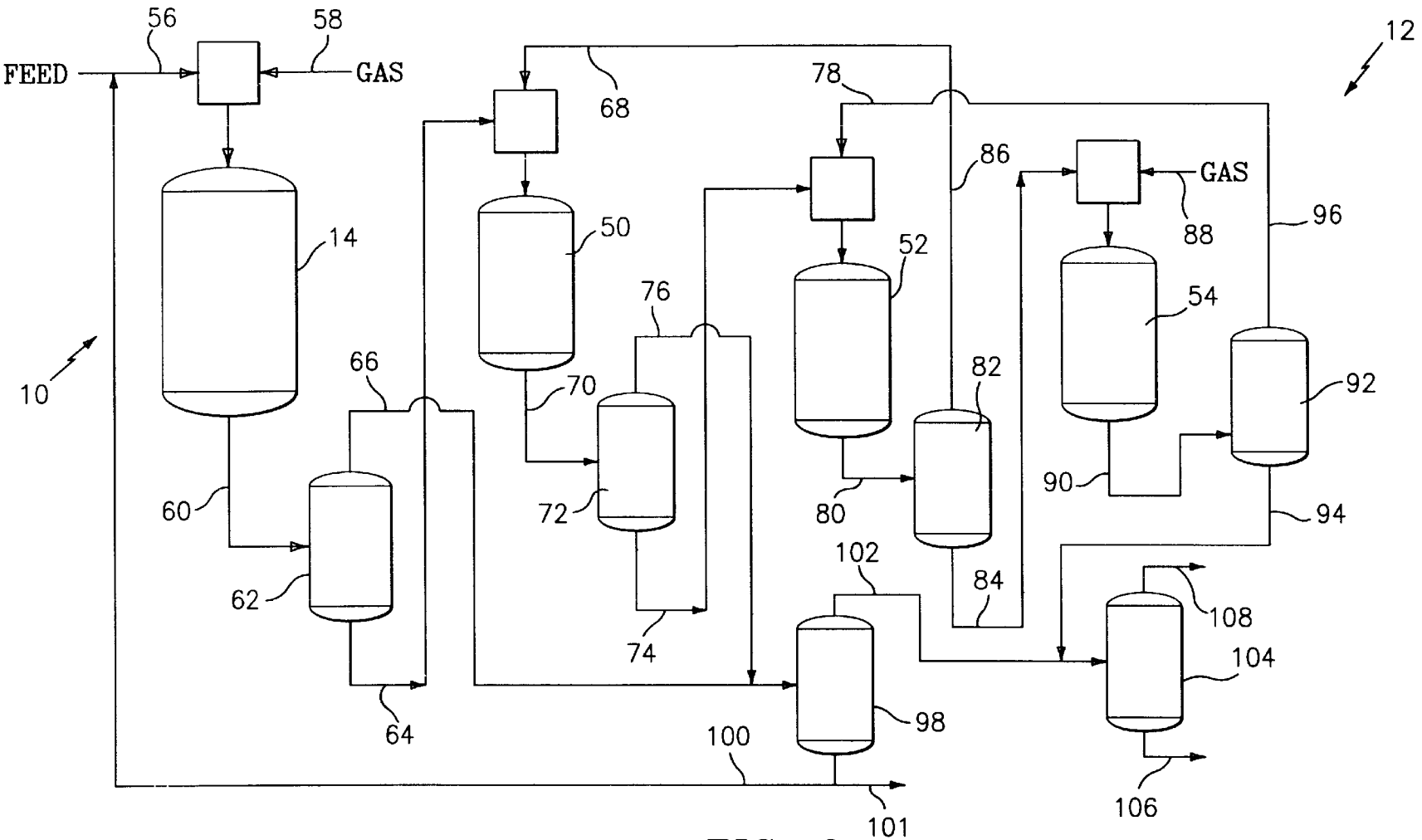
FIG. 2 schematically illustrates an alternative embodiment of the process and system in accordance with the present invention.

Turning now to FIG. 2, a further embodiment of the present invention is illustrated.

As shown, first stage 10 includes a single reactor 14 in similar fashion to the embodiment of FIG. 1.

Second stage 12 in this embodiment includes reactors 50, 52, and 54, and each reactor is operated in a similar fashion to the second stage reactors of the embodiment of FIG. 1 so as to provide a single cocurrent stage in first stage 10 and a globally countercurrent, locally cocurrent process in second stage 12. Thus, feed 56 and fresh hydrogen-containing gas 58 are fed cocurrently to reactor 14 so as to produce product 60 which is fed to separator 62 to produce an intermediate liquid hydrocarbon product 64 and gas phase 66 containing hydrogen and hydrogen sulfide as major components. Intermediate hydrocarbon product 64 is then fed to second stage 12, where it is mixed with recycled gas 68 and fed cocurrently through reactor 50 to produce product 70 which is fed to separator 72. Separator 72 separates a further intermediate liquid hydrocarbon product 74 and a gas phase 76 containing hydrogen and hydrogen sulfide as major components.

Intermediate hydrocarbon product 74 is then combined with recycled hydrogen 78 and fed to reactor 52, cocurrently, so as to produce a further intermediate product 80 which is fed to separator 82 for separation of a further liquid hydrocarbon feed 84 and a gas phase 86 containing hydrogen and hydrogen sulfide as major components which are advantageously fed to upstream reactor 50 as recycled gas 68. Hydrocarbon product 84 is then advantageously combined with a fresh hydrogen feed 88 and fed to last reactor 54, cocurrently, for further hydrodesulfurization so as to provide product 90 which is fed to separator 92 for separation of hydrocarbon liquid phase 94 and gas phase 96 containing hydrogen and hydrogen sulfide as major components. Advantageously, gas phase 96 is fed to upstream reactor 52 and recycled as recycled gas 78 for use in that process, while liquid phase 94 can be treated as a final product, or alternatively can be treated further as discussed below.

In accordance with the present invention, a hydrodesulfurization catalyst is present in each reactor, and each successive hydrocarbon product has a sulfur content reduced as compared to the upstream hydrocarbon feed. Further, the final hydrocarbon product has a final sulfur content which is substantially reduced as compared to the initial feed, and which is advantageously less than or equal to about 10 wppm so as to be acceptable under new regulations from various Government agencies.

Further, it should be readily apparent that second stage 12 of the embodiment of FIG. 2 is globally countercurrent, as with the embodiment of FIG. 1. Specifically, hydrocarbon is fed from reactor 50 to reactor 52 and finally to final reactor 54, while gas phase is fed from reactor 54 to reactor 52 and finally to reactor 50. This provides for the advantages of a globally countercurrent process, while avoiding flooding problems which could occur with locally countercurrent processes.

Still referring to FIG. 2, it may be desirable to feed gas phases 66 and 76 to a low temperature separator 98 which operates to remove volatile hydrocarbon product 100, which can be recycled back as additional feed 56 for further treatment in accordance with the process of the present invention, with a purge stream 101 also as shown. Low temperature separator 98 also separates a gas phase 102 which can advantageously be mixed with final product 94 and fed to a final separator 104 so as to obtain a further treated final hydrocarbon product 106 and a final gas phase 108 containing hydrogen and the bulk of removed sulfur. Product 106 can be further treated for enhancing various desired qualities as a hydrocarbon fuel, or can be utilized as hydrocarbon fuel without further treatment, since the sulfur content has been advantageously reduced to acceptable levels.

Final gas phase 108 can advantageously be fed to a stripper or other suitable unit for removal of hydrogen sulfide to provide additional fresh hydrogen for use as hydrogen feeds 58 or 88 in accordance with the process of the present invention.

It should readily be appreciated that FIGS. 1 and 2 further illustrate a system for carrying out the process in accordance with the present invention.

Typical feed for the process of the present invention includes Diesel, gasoil and naphtha feeds and the like. Such feed will have an unacceptably high sulfur content, typically greater than or equal to about 1.5% wt. wppm. The feed and total hydrogen are preferably fed to the system at a global ratio of gas to feed of between about 100 scfb and about 4000 scfb (std. cubic feet/barrel). Further, each reactor may suitably be operated at a temperature of between about 250° C. and about 420° C., and a pressure of between about 400 psi and about 1800 psi.

In accordance with the present invention, it should readily be appreciated that catalyst volume and gas streams are distributed between the first zone and the second zone. In accordance with the present invention, the most suitable distribution of gas catalyst is determined utilizing an optimization process. It is preferred, however, that the total catalyst volume be distributed between the first zone and the second zone with between about 20 and about 80% volume of the catalyst in the first zone and between about 80 and about 20% volume of the catalyst in the second zone. Further, as discussed above, the total hydrogen is fed to the system of the present invention with one portion to the first zone and the other portion to the final reactor of the second zone. It is preferred that between about 20 and 70% volume of the total hydrogen for the reaction be fed to the first zone, with the balance being fed to the final reactor of the second zone.

Within the above ranges, it is further preferred to position between about 30% and about 50% volume of the catalyst in the first zone, more preferably between about 35% and about 40% of the catalyst in the first zone, with the balance being distributed through the second zone. It is further preferred that between about 50 and about 70% volume of the total hydrogen flow rate be fed to the first zone, with the balance being fed to the second zone. As set forth below, these particularly preferred ranges provide for excellent results in the hydroprocessing scheme of the present invention.

It should also be appreciated that the process of the present invention can advantageously be used to reduce sulfur content of naphtha feed. In such processes, condensers would advantageously be positioned after each reactor, rather than separators, so as to condense the reduced sulfur naphtha hydrocarbon product while maintaining the gas phase containing hydrogen and hydrogen sulfide as major components. When olefins content becomes larger than 15% wt., the condenser temperature of the first unit after the first reactor can be adjusted so that major light olefins leave the system with the gas phase containing hydrogen and hydrogen sulfide. In all other respects, this embodiment of the present invention will function in the same manner as that described in connection with FIGS. 1 and 2.

Figure 3:
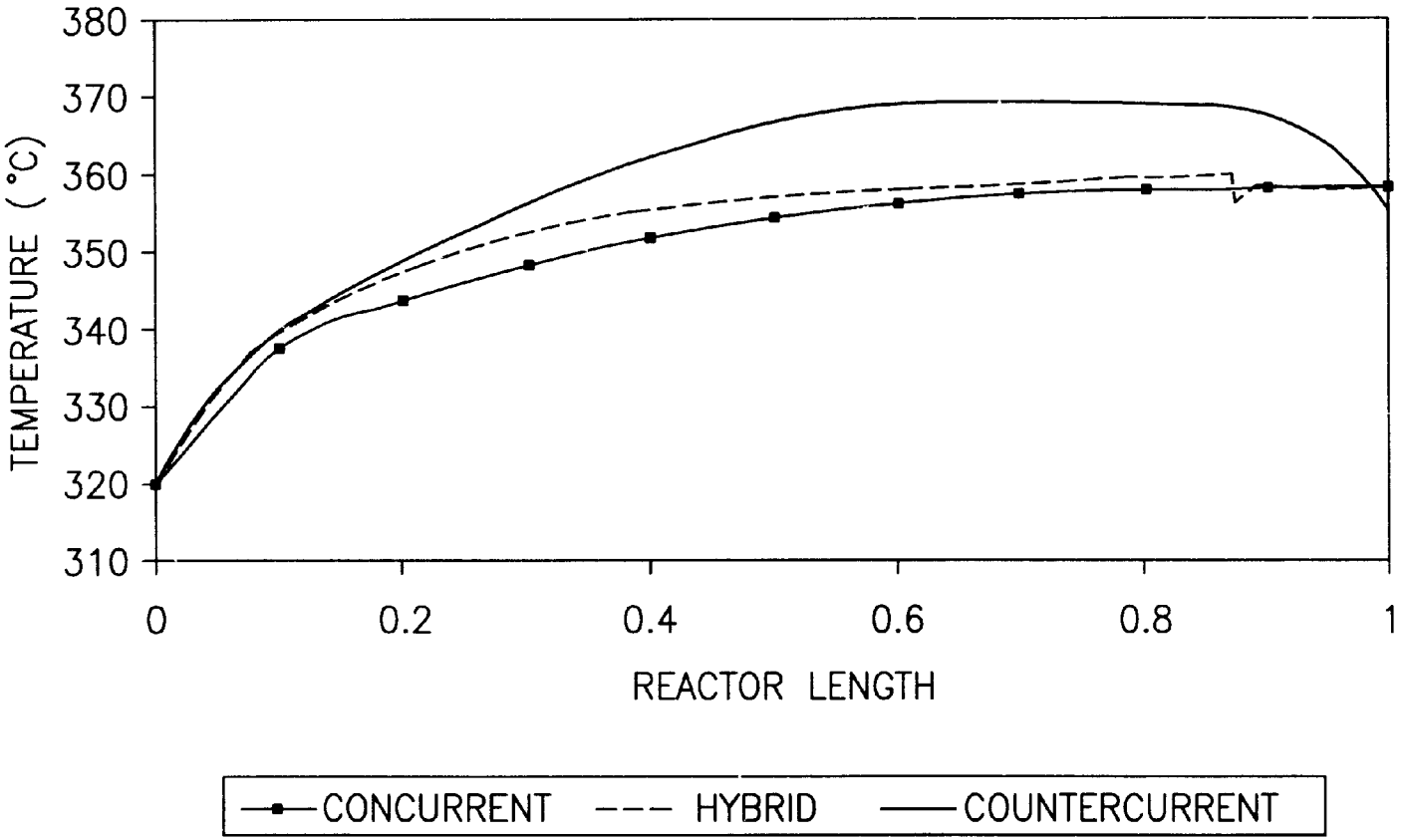
FIG. 3 illustrates the temperature of a process as a function of reactor length for cocurrent and countercurrent processes, as well as the process of the present invention.

Turning now to FIG. 3, and as set forth above, the process of the present invention combining in a hybrid fashion a first stage purely cocurrent reaction and a second stage which is globally countercurrent and locally cocurrent advantageously provides for operation of the reactors at reduced temperatures as compared to countercurrent processes. FIG. 3 illustrates temperature as a function of dimensionless reactor length for a typical cocurrent process, for a countercurrent process, and for a hybrid process in accordance with the present invention. As shown, the temperature in the countercurrent process is substantially higher than the hybrid process of the present invention, with the result that the catalyst of the hybrid process of the present invention is subjected to less severe and damaging conditions.

In accordance with the present invention, improved results are obtained using the same amounts of catalyst and hydrogen as a conventional countercurrent or cocurrent process. In accordance with the present invention, however, the hydrogen feed is divided into a first portion fed to the first stage and a second portion fed to the second stage, and the catalyst volume is also divided between the first stage and second stage, which are operated as discussed above, so as to provide improved hydrodesulfurization as desired.

As set forth above, one particularly advantageous hydrocarbon feed with which the process of the present invention can be used is a gasoil feed. In a typical application, a reactor can be provided having a reactor diameter of about 3.8 meters, a reactor length of about 20 meters, and a cocurrent feed of hydrogen to gasoil at a ratio of hydrogen gas to gasoil of about 270 $Nm^3/m^3$, a temperature of about 340° C., a pressure of about 750 psi and a liquid hourly space velocity (LHSV) through the reactor of about 0.4 $h^{-1}$.

The gasoil may suitably be a vacuum gasoil (VGO) an example of which is described in Table 1 below.

TABLE 1

| | |
|---|---|
| API gravity (60° C.) | 17.3 |
| Molecular weight (g/mol) | 418 |
| Sulfur content, % wt | 2 |
| Simulated Distillation (° C.) | |
| IBP/5, % v | 236/366 |
| 10/20, % v | 392/413 |
| 30/50, % v | 431/454 |
| 70/80, % v | 484/501 |
| 90/95, % v | 522/539 |
| FBP | 582 |

For such a feedstock, easy-to-react (ETR) sulfur compounds would be, for example, 1-butylphenantrothiophene. When contacted with hydrogen at suitable conditions, this sulfur compound reacts with the hydrogen to form hydrogen sulfide and butylphenantrene. A typical difficult-to-react (DTR) sulfur compound in such a feed is heptyldibenzothiophene. When contacted with hydrogen gas under suitable conditions, this reacts to form hydrogen sulfide and heptylbiphenyl.

Figure 12:
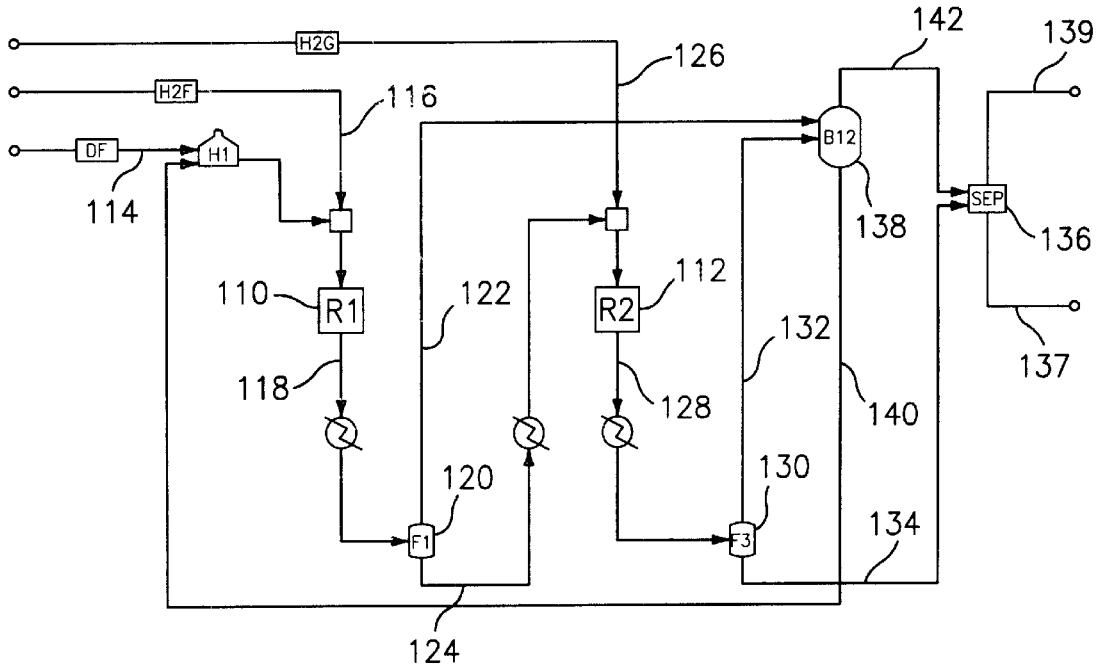
FIG. 12 schematically illustrates a process and system in accordance with a further embodiment of the present invention.

In accordance with a further aspect of the present invention, an alternate processing scheme and method are provided as illustrated in FIG. 12. In accordance with this aspect of the present invention, it has been found that through utilization of multiple reactors, with distribution of a portion of catalyst in each reactor and a portion of total hydrogen-containing gas flow rate to each reactor, sulfur reduction is improved drastically as compared to feed of the same amount of materials including the same amount of catalyst to a single reactor having the same volume.

FIG. 12 shows a system in accordance with this aspect of the present invention, and including a first reactor or hydroprocessing zone 110 and an additional or second hydroprocessing reactor or zone 112. A suitable sulfur-containing feedstock or other feed in need of hydroprocessing is provided from a source as shown at 114, and is fed to first zone 110 cocurrently with a first portion 116 of the total desired gas flow rate. A first hydrocarbon product 118 results, and is fed to a separator 120 for separating a gas phase 122 containing hydrogen and hydrogen sulfide, and a liquid phase 124 containing liquid hydrocarbons treated in first zone 110. Liquid phase 124 is advantageously fed to second zone 112 cocurrently with a remainder portion 126 of total desired gas flow so as to produce a product stream 128 which is advantageously fed to a separator 130 to separate a further gas phase 132 containing hydrogen and hydrogen sulfide gases and a further liquid phase 134 containing further-treated hydrocarbons. If desired, liquid phase 134 can be fed to a further separator 136 as shown so as to complete separation of the upgraded hydrocarbon stream and obtain the desired hydrocarbon fraction as a final or intermediate product 137 containing reduced sulfur content.

Still referring to FIG. 12, gas phase 122 separated at separator 120 can advantageously be fed to a further separator 138, as can gas phase 132 from separator 130, so as to separate out any remaining liquid hydrocarbon feedstock as a liquid phase 140 which can advantageously be recycled back to feed 114 for further treatment in zones 110, 112. A gas phase 142 from further separator 138 can advantageously be recycled for further use as hydrogen-containing gas, and/or can be fed to further separator 136 along with liquid phase 134 for still further separation of a gas phase 139 and the treated liquid hydrocarbon phase 137.

Still referring to FIG. 12, first zone 110 and second zone 112 are advantageously provided with hydroprocessing catalyst, with a first portion of hydroprocessing catalyst being positioned in first zone 110, and a remainder portion of hydroprocessing catalyst being positioned in second zone 112. Most preferably, first zone 110 contains between about 30 and about 70% wt. of the total volume of hydroprocessing catalyst, while second zone 112 contains the remainder, and first portion 116 of hydrogen-containing gas preferably includes between about 30 and about 80% vol. of the total gas flow rate to zones 110, 112, with the remainder of gas being fed to second zone 112. Suitable hydroprocessing catalysts include but are not limited to hydrodesulfurization, hydrogenation, hydrocracking, isomerization, hydrodenitrogenation and the like. The hydrogen-containing gas may be hydrogen or a mixture of gases including hydrogen.

The embodiment of the present invention as illustrated in FIG. 12, which is referred to herein as a cross flow embodiment, advantageously provides for substantially improved sulfur removal as compared to a conventional process utilizing a single reactor having the same reactor volume as zones 110, 112 combined, and containing the same total amount of catalyst with the same total amount of gas flow. This is particularly advantageous in providing for an extremely simple process and system, which can be operated using the same amount of catalyst and gas, and substantially the same amount of reactor space, and which provides excellent sulfur removal as desired.

In accordance with this embodiment of the present invention, separators 120, 130 can advantageously be any conventional type of separator, such as flash drums, while further separator 136 and further separator 138 may also advantageously be a flash drum. Also, an internal tray within the reactor can be used to provide separator integrated with the reactor unit.

In further accordance with the present invention as illustrated in FIG. 12, it has been found that second zone 112 is advantageously provided as at least one, and preferably a plurality, of separate and serially arranged reactors or zones, each containing a portion of the remainder of catalyst volume to be used, and each being fed with a portion of the remainder flow rate of hydrogen-containing gas phase.

Figure 13:
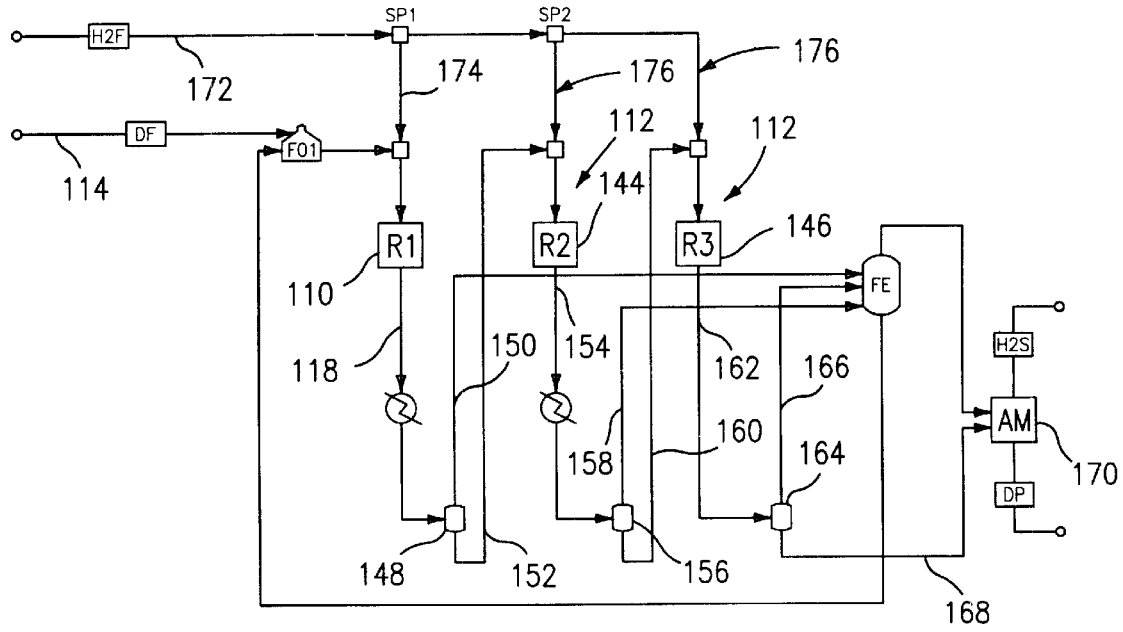
FIG. 13 schematically illustrates an alternative embodiment of the present invention similar to FIG. 12.

FIG. 13 illustrates an embodiment in accordance with this aspect of the present invention utilizing a total of three reactors including a first reactor or zone 110 and a second zone 112 containing two reactors or zones 144, 146. In accordance with this aspect of the present invention, feed 114 is first fed to first zone 110 so as to produce hydrocarbon product 118 which is fed to separator 148 to produce gas phase 150 and liquid phase 152. Liquid phase 152 is advantageously fed to first reactor 144 of second zone 112 so as to produce an intermediate hydrocarbon stream 154 which is then advantageously fed to separator 156 so as to produce a gas phase 158 and a liquid phase 160. Liquid phase 160 is advantageously then fed to second reactor 146 of second zone 112 so as to produce a final hydrocarbon stream 162 which can be fed to separator 164 so as to produce a gas phase 166 and liquid hydrocarbon phase 168. Liquid phase 168 advantageously has, in accordance with the present invention, a substantially improved characteristic, preferably substantially reduced sulfur content, as desired in accordance with the present invention. Liquid phase 168 can itself be used as final product, or can be fed to additional treatment stages such as further separator 170 or other processing steps as desired.

Still referring to FIG. 13, the total gas flow is shown at 172, and is divided into a first portion 174 which is fed cocurrently with feed 114 to first zone 110 as shown. Remainder 176 of total gas flow 172 is then distributed between reactors 144, 146 as shown, cocurrently with liquid phases 152, 160 respectively.

Further, a suitable hydroprocessing catalyst, preferably a hydrodesulfurization catalyst, is distributed over zones 110, 144, 146, with a first portion in first zone 110, and a remainder portion distributed over zones 144, 146. In accordance with the present invention, gas is preferably fed to zones 110, 144, 146 such that first portion 174 is between about 30 and about 80% vol. of total gas flow 172, and remainder portion 176 is distributed, preferably equally, between zones 144, 146. Further, the total catalyst volume is preferably distributed such that a first portion of catalyst, between about 30 and about 70% wt. of the total catalyst volume, is disposed in first zone 110, and the remainder is disposed in zones 144, 146, preferably equally disposed therein.

The cross flow systems and processes as illustrated in FIGS. 12 and 13 advantageously provides for simplified flow schemes that nevertheless result in substantially reduced sulfur content in the final treated product as compared to conventional systems using a single reactor.

It should of course be appreciated that although portions of the above descriptions are given in terms of hydrodesulfurization processes, the hybrid and cross flow processes of the present invention are readily applicable to other hydroprocessing systems, and can advantageously be used to improve hydroprocessing efficiency in various different processes while reducing problems routinely encountered in the art.

EXAMPLE 1

A VGO feed as described in Table 1 was used with a series of different hydrodesulfurization processes, and conversion of sulfur compounds and sulfur in the final product were modeled for each case. The results are set forth in Table 2 below.

TABLE 2

| CASE | VGO Flow rate (BBL/D) | Gas Flow rate $Nm^3/h$ | CONVERSION % $C_4FT^{(ETR)}$ | CONVERSION % $C_6DBT^{(DTR)}$ | % S (wt.) OUTLET | REACTOR VOLUME ($m^3$) | LHSV ($h^-$) |
|---|---|---|---|---|---|---|---|
| CASE 1 | 2000 | 35162 | 94.14 | 75.74 | 0.19 | 322<br>L = 28 m | 0.4 |
| CASE 2 | 20000 | 35162 | 98.79 | 98.37 | 0.0256 | 322<br>R1 = R2 = . . . = Rn<br>L = 28 m<br>n = 20 | 0.4 |
| CASE 3 | 20000 | 35162 | 99.3 | 95.9 | 0.0271 | 322<br>L = 28<br>R1 = R2 = R3 | 0.4 |
| CASE 4 | 20000 | 35162 | 98.99 | 90.259 | 0.053 | 322<br>L = 28<br>R1 = R2 | 0.4 |
| CASE 5 | 20000 | First<br>26371.5<br>Last<br>8790.5 | 99.8 | 97 | 0.016 | 322<br>L = 28 m<br>R = 60% L<br>R2 = R3 = 20% L | 0.4 |
| CASE 6 | 20000 | First<br>26371.5<br>Last<br>8790.5 | 99.93 | 99.5 | 0.00317 | 483 | 0.27 |
| CASE 7 | 20000 | 35162 | 99.9 | 99.2 | 0.00313 | L = 133 m<br>1508 | 0.09 |
| CASE 8 | 20000 | First<br>26371.5<br>Last<br>8790.5 | 99.9 | 99.7 | 0.0021 | 962 | 0.14 |
| CASE 9 | 20000 | 35162 | 99.9 | 96.4 | 0.0162 | 962<br>R1, L = 28 m, D = 3.8,<br>R2, L – 20.86 m,<br>D = 4.42 m,<br>R2, L = 20.86 m,<br>D = 4.42 m | 0.14 |
| CASE 10 | 20000 | 35162 | 99.9 | 99.5 | 0.00312 | 962<br>R1, L = 28 m, D = 3.8,<br>R2, L = 20.86 m,<br>D = 4.42 m,<br>R2, L = 20.86 m,<br>D = 4.42 m | 0.14 |

where D = diameter;
R = length of reactor; and
L = total length.

In Table 2, cases 5, 6 and 8 are carried out in accordance with the process of the present invention. For comparison purposes, cases 1 and 7 were carried out utilizing a single reactor through which were fed, cocurrently, VGO and hydrogen.

Case 2 was carried out utilizing 20 reactors arranged for globally countercurrent and locally cocurrent flow as illustrated in the second stage portion of FIG. 1.

Cases 3 and 10 were also carried out utilizing globally countercurrent and locally cocurrent flow as in stage 2 alone of FIG. 1.

Case 4 was carried out utilizing two reactors with an intermediate hydrogen sulfide separation stage, and case 9 was carried out utilizing pure cocurrent flow, globally and locally, through three reactors.

At the flow rates shown, results were modeled and are set forth in Table 2.

Cases 1–5 were all carried out utilizing reactors having a volume of 322 $m^{3'}$ and at the same VGO and gas flow rates. As shown, case 5, utilizing the two stage hybrid process of the present invention, provided the best results in terms of conversion of sulfur compounds and sulfur remaining in the final product. Further, this substantial improvement in hydrodesulfurization was obtained utilizing the same reactor volume, and could be incorporated into an existing facility utilizing any configuration of cases 1–4 without substantially increasing the area occupied by the reactors.

Case 6 in Table 2 shows that by reasonable increase in reactor volume, still further advantageous results can be obtained in accordance with the process of the present invention, and final sulfur content would satisfy the strictest of expected regulations in connection with maximum sulfur content, and this is accomplished through only a small increase in reactor volume.

Case 7 of Table 2 shows that in order to accomplish similar sulfur content results to case 6, a single reactor operated in a single cocurrent conventional process would require almost 4 times the reactor volume as case 6 in accordance with the process of the present invention.

Cases 8, 9 and 10 are modeled for a reactor having a volume of 962 $m^3$, and the hybrid process of the present invention (Case 8) clearly shows the best results as compared to Cases 9 and 10.

In accordance with the foregoing, it should be readily apparent that the process of the present invention is advantageous over numerous alternative configurations.

EXAMPLE 2

In this example, a Diesel feed was treated utilizing several different process schemes, and sulfur compound conversion and sulfur content in the final product were calculated. The Diesel for this example had characteristics as follows:

| Diesel | |
|---|---|
| API = | 27 |
| MW = | 213 |
| Sulfur = | 1.10% wt |
| Simulated Distillation (° C.) | |
| IBP-5 | 177/209 |
| 10–20 | 226/250 |
| 30–40 | 268/281 |
| 50–60 | 294/308 |
| 70–80 | 323/339 |
| 90–95 | 357/371 |
| FBP | 399 |

Table 3 below sets forth the process conditions and results of each case.

TABLE 3

| CASE | Diesel Flow rate (BBL/D) | Gas Flow rate $Nm^3/h$ | CONVERSION EDBT(ETR) | CONVERSION DMDBT(DTR) | % S (wt) OUTLET | REACTOR VOLUME ($m^3$) | LHSV ($h^{-1}$) |
|---|---|---|---|---|---|---|---|
| CASE 1 | 35000 | 24039 | 96.5 | 81.6 | 0.072 | 370<br>L = 35 m | 0.63 |
| CASE 2 | 35000 | 24039 | 93.72 | 93.44 | 0.07 | 370<br>R1 = R2 . . . = Rn<br>L = 35 m<br>n = 20 | 0.63 |
| CASE 3 | 35000 | First 18029<br>Last 6010 | 99.28 | 96.8 | 0.0135 | 370<br>L = 35 m<br>R1 = 60% L<br>R2 = R3 = 20% L | 0.63 |
| CASE 4 | 35000 | 24039 | 96.52 | 81.6 | 0.072 | 370<br>L = 35 m | 0.63 |
| CASE 5 | 72000 | First 37097<br>Last 12366 | 96.08 | 82.53 | 0.074 | 370<br>L = 35 m | 1.3 |

Case 1 of Table 3 was carried out by cocurrently feeding a Diesel and hydrogen feed through a single reactor having the shown length and volume.

Case 2 was carried out feeding Diesel and hydrogen globally countercurrently, and locally cocurrently, through reactors having the same total length and volume as in Case 1.

Case 3 was carried out in accordance with the process of the present invention, utilizing a first single reactor stage and a second stage having two additional reactors operated globally countercurrently and locally cocurrently, with the gas flow rate split as illustrated in Table 3. As shown, the process in accordance with the present invention (Case 3) clearly performs better than Cases 1 and 2 for sulfur compound conversion and final sulfur content while utilizing a reactor system having the same volume. Case 4 is the same as Case 1 and is presented for comparison to Case 5 wherein a process in accordance with the present invention was operated to obtain the same sulfur content from the same reactor volume as the conventional scheme for process so as to illustrate the potential increase in reactor capacity by utilizing the process of the present invention. By adjusting the process to obtain substantially the same final sulfur content, the same reactor volume is able to provide more than double the Diesel treatment capacity as compared to the conventional process.

EXAMPLE 3

Figure 4:
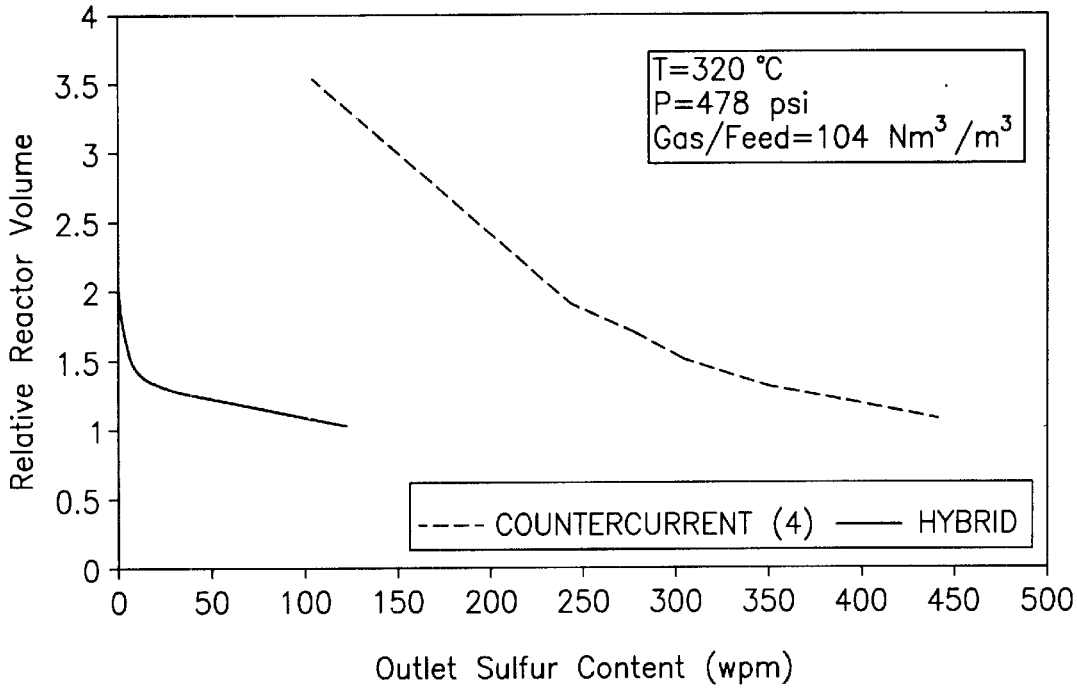
FIG. 4 illustrates the relationship of sulfur content and relative reactor volume for a process according to the present invention and a globally countercurrent process.

In this example, a process in accordance with the present invention was compared to a globally countercurrent and locally cocurrent process. Each process was utilized having 4 reactors with the same catalyst, a Diesel feed, and operating at a temperature of 320° C., a pressure of 478 psi, and a ratio of hydrogen to feed of 104 $Nm^3/m^3$. FIG. 4 shows the results in terms of sulfur content in the final product as a function of relative reactor volume. As shown, the hybrid process of the present invention provides substantially improved results.

EXAMPLE 4

Figure 5:
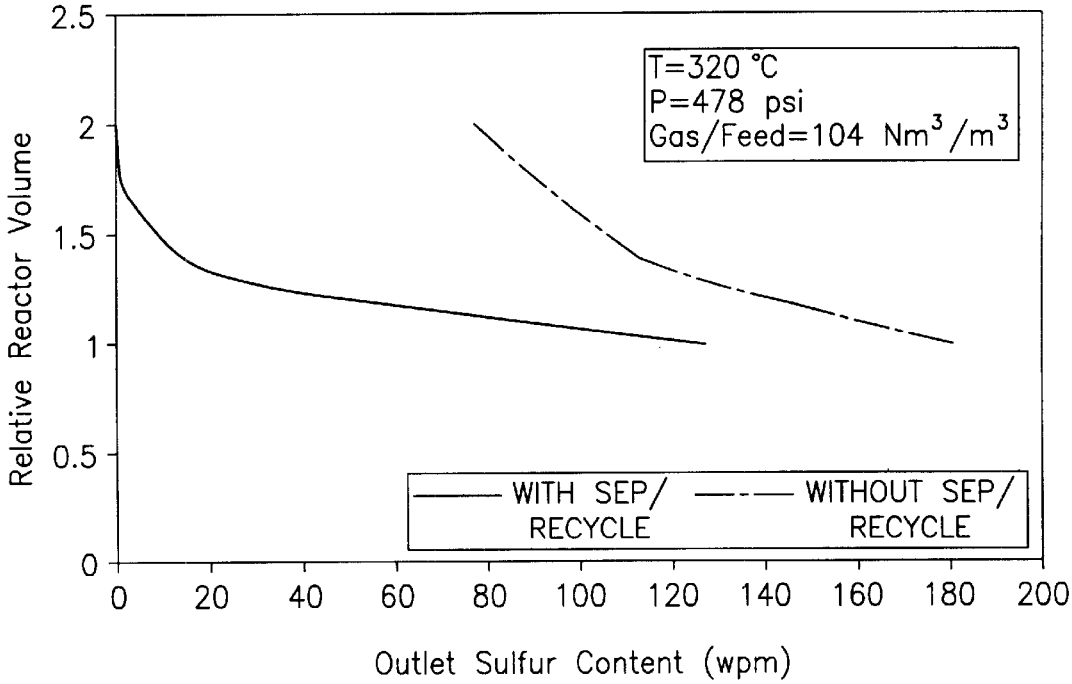
FIG. 5 illustrates sulfur content as a function of relative reactor volume for processes according to the present invention with and without cold separator recycling.

In this example, two processes were evaluated. The first was a process in accordance with a preferred embodiment of the present invention wherein cold separators were positioned after each reactor for recycling condensed vapors. For the same reactors, feed, temperature, pressure and hydrogen/feed ratio, FIG. 5 illustrates the relation between final sulfur content and relative reactor volume for a process in accordance with the present invention using cold separators (curve 1), as compared to a process in accordance with the present invention without cold separators (curve 2). As shown, the use of cold separators provides additional benefit in reducing the final sulfur content by allowing sufficient hydrodesulfurization of all sulfur species, even those that go into the gas phase.

EXAMPLE 5

Figure 6:
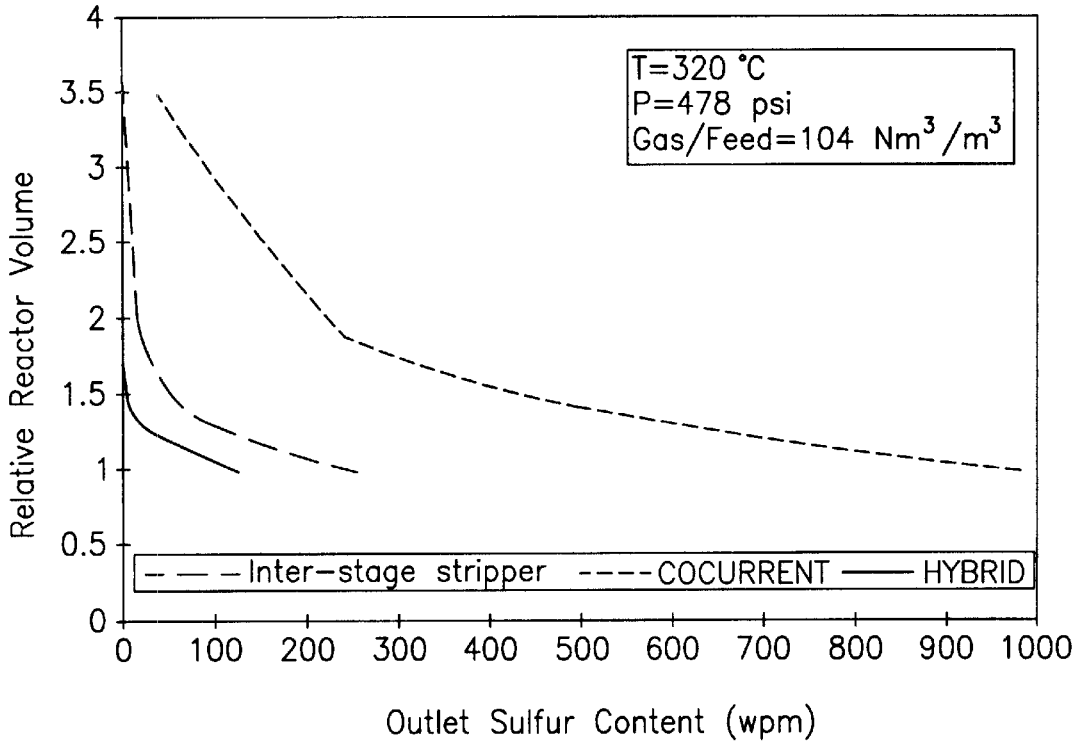
FIG. 6 illustrates the relationship between outlet sulfur content and relative reactor volume for a process according to the present invention, a pure cocurrent process, and a two-reactor inter-stage stripping process.

In this example, a comparison is presented showing final sulfur content as a function of relative reactor volume for a conventional cocurrent process, for a two-stage process using an inter-stage stripper, and for a process in accordance with the present invention. The feedstock, temperature, pressure and hydrogen/feed ratio were maintained the same, and the results are illustrated in FIG. 6. As shown, the process of the present invention provides better results in terms of final sulfur content than either of the other two processes.

EXAMPLE 6

In this example, the importance of the proper distribution of hydrogen feed to the first stage and second stage in the process of the present invention is demonstrated.

An example is provided to evaluate hydrogen distribution using a hydrogen feed of 50% to the first stage, and a hydrogen feed of 50% to the last reactor of the second stage. This was compared to a case run using the same equipment and total gas volume, with an 80% feed to the first stage and a 20% feed to the second stage.

Figure 7:
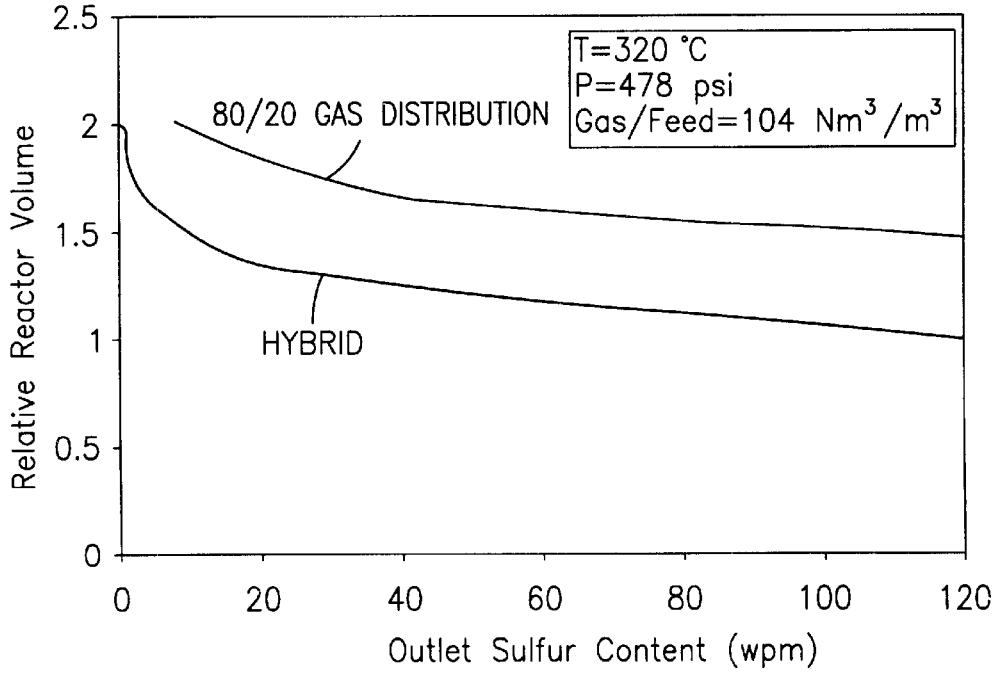
FIG. 7 illustrates the relationship between outlet sulfur content and relative reactor volume for a process according to the present invention and for a process having different ratio of hydrogen distribution.

FIG. 7 shows the results in terms of outlet sulfur content as a function of relative reactor volume for the process in accordance with the present invention and for the 80/20 hydrogen distribution. As shown, in this instance the 50/50 distribution provides better results.

EXAMPLE 7

In this example, the importance of the distribution of catalyst between the first and second stages is illustrated. A four reactor setup in accordance with the present invention, with one reactor in the first stage and three reactors operated globally countercurrent and locally cocurrent in the second stage was used. In one evaluation according to the present invention, 30% of the total catalyst volume was positioned in the first reactor, and 70% of the total catalyst volume was divided equally among the three reactors of the second stage.

For comparison, the same system was operated providing 70% of total catalyst volume in the first stage, and 30% of catalyst volume in the second stage.

Figure 8:
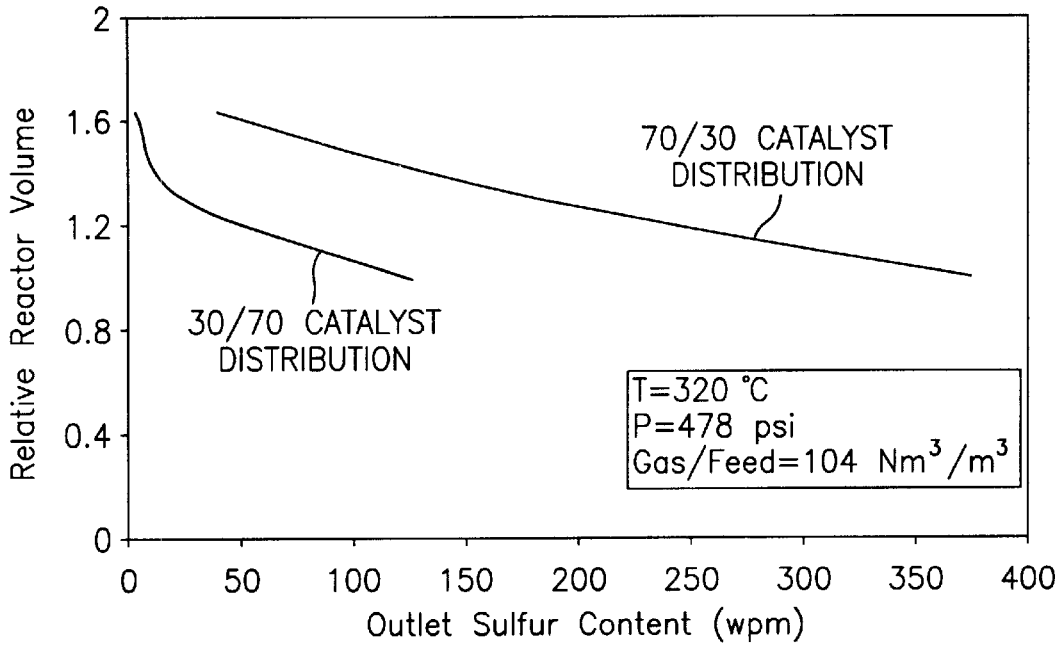
FIG. 8 illustrates the relationship between outlet sulfur content and relative reactor volume for a process according to the present invention and for a process having an inverse distribution of catalyst between first and second stages.

FIG. 8 shows the results in terms of sulfur content as a function of relative reactor volume for the 30/70 process of the present invention as compared to the 70/30 process. As shown, the process of the present invention provides significantly better results.

EXAMPLE 8

In this example, the hydrogen partial pressure was evaluated, as a function of dimensionless reactor length, for a process in accordance with the present invention and for a pure cocurrent process.

Figure 9:
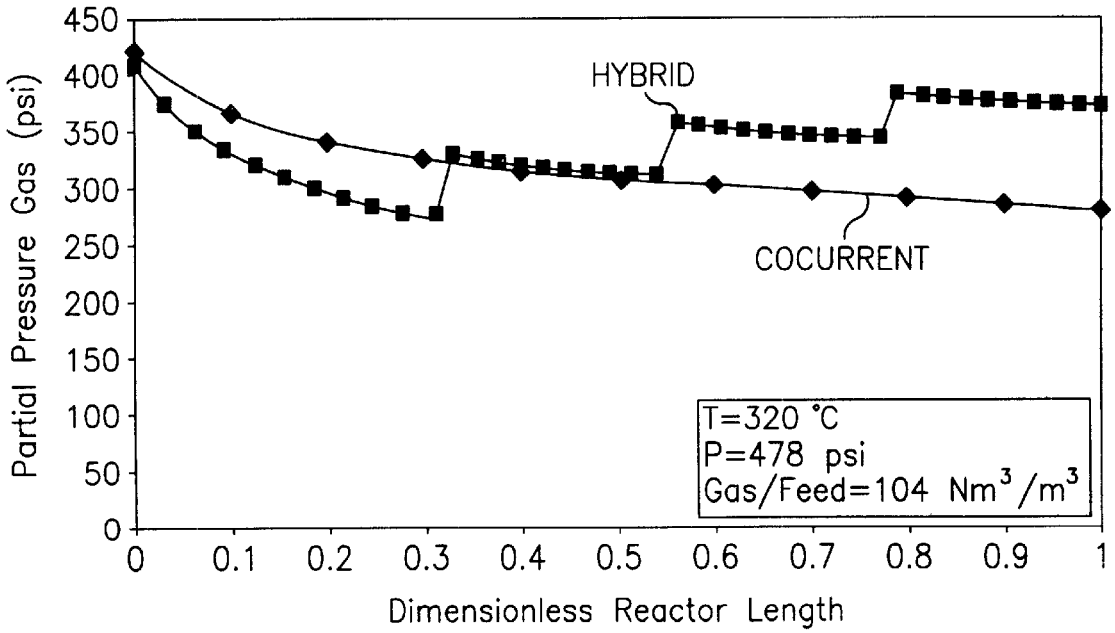
FIG. 9 illustrates the relationship between dimensionless reactor length and hydrogen partial pressure for a process according to the present invention and a pure cocurrent process.

FIG. 9 shows the results of this evaluation, and shows that the process in accordance with the present invention provides for significantly increased hydrogen partial pressure at the end of the reactor, which is desirable. This provides for higher hydrogen partial pressures so as to provide reacting conditions that are most suited for reacting the most difficult-to-react sulfur species, thereby providing conditions for enhanced hydrodesulfurization, particularly as compared to the pure cocurrent case.

EXAMPLE 9

In this example, a comparison is provided for temperature as a function of dimensionless reactor length for a pure cocurrent process, a pure countercurrent process and the hybrid process of the present invention.

Figure 10:
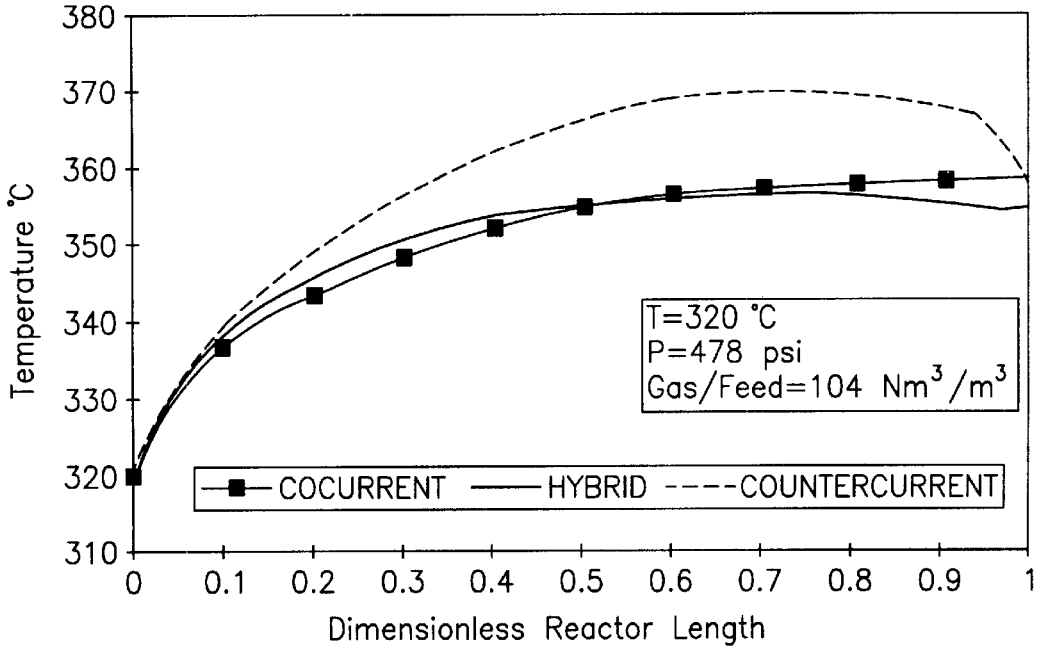
FIG. 10 illustrates the relationship between dimensionless reactor length and reactor temperature for a process according to the present invention as well as pure cocurrent and pure countercurrent processes.

For the same reactor volume, catalyst volume and hydrogen/feed ratio, FIG. 10 shows the resulting temperatures over dimensionless reactor length. As shown, the countercurrent process has the highest temperatures. Further, the hybrid process of the present invention is quite similar in temperature profile to that of the pure cocurrent process, with the exception that there is a slight decrease in temperature toward the reactor outlet.

This is beneficial since the higher temperatures, particularly those experienced with countercurrent process, serve to accelerate catalyst deactivation.

EXAMPLE 10

Figure 11:
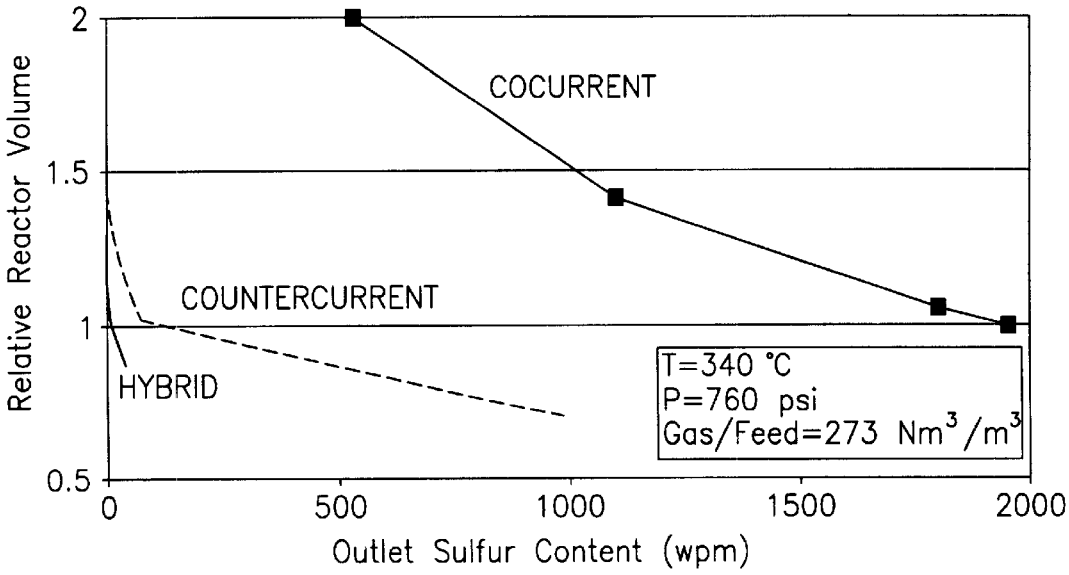
FIG. 11 illustrates the relationship between outlet sulfur content and relative reactor volume for a process according to the present invention as well as a pure cocurrent and pure countercurrent process.

In this example, the sulfur content as a function of relative reactor volume was evaluated for a process in accordance with the present invention, a pure cocurrent process and a globally countercurrent process for a VGO feedstock with a process using a four-reactor train, with the same feedstock, and a temperature of 340° C., a pressure of 760 psi and a hydrogen/feed ratio of 273 $Nm^3/m^3$. FIG. 11 shows the results of this evaluation, and shows that the process of the present invention performs substantially better than the pure cocurrent and pure countercurrent processes, especially in the range of resulting sulfur content which is less than 50 wppm.

EXAMPLES 11–14

The following Examples 11 through 14 demonstrate excellent results obtained using a system as illustrated in FIG. 12 as compared to conventional systems.

In Examples 11–14 to follow, the feedstock used had characteristics as set forth below in Table 4

TABLE 4

| | |
|---|---|
| API gravity | 33 |
| Sulfur | 0.63 wt % |
| Aromatics | 31.9 wt % |
| Distillation ASTM D86 (% V, ° F.) | (IBP,111)/(5,268)/(10,359)/(20,408)/(30,457)/(50,514)/(70,566)/(80,602)/(90,636)/(95,653)/(FBP,673) |

The total sulfur content in this feedstock was represented by two different sulfur species, one of which was an easy-to-react species comprising 80% molar of total sulfur, and the other being a difficult-to-react species presenting 20% molar of the total sulfur species.

EXAMPLE 11

In this example, a system and process as illustrated in FIG. 12, having two reactors (R1 and R2), and having total catalyst volume in a fixed amount, was evaluated while varying the relative distribution of hydrodesulfurization catalyst between the first and second reactors. The other parameters of interest were fixed as shown in Table 5 below.

TABLE 5

| | |
|---|---|
| Temperature (inlet) | 650° F. |
| Pressure | 600 psi |
| Diameter of each reactor | 10 ft |
| Total length of the reactors R1 + R2 | 50 ft |
| Total volume of catalyst | 3927 $ft^3$ |
| Hydrogen flow rate to R1 | 1000 kmol/h |
| Hydrogen flow rate to R2 | 200 kmol/h |
| Feedstock | 32000 b/d |
| Space velocity | 1.9 $h^{-1}$ |
| Inlet $H_2$/feedstock | 753 scfb |

Figure 14:
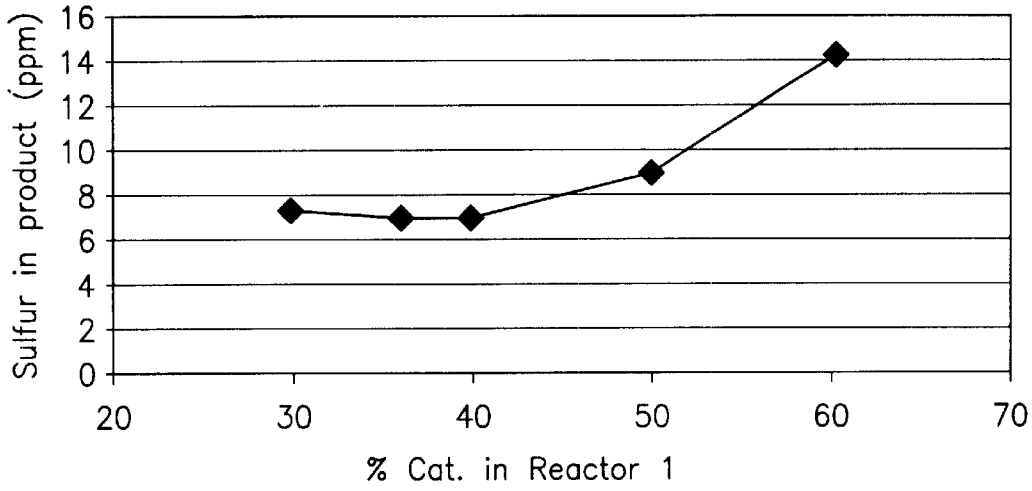
FIG. 14 graphically illustrates sulfur content in the final product as a function of the percentage of total catalyst volume positioned in a first reactor.

The amount of catalyst in the first reactor (R1) was varied between 30% and 60% of the total catalyst volume, and FIG. 14 shows sulfur in the final product as a function of this variance in catalyst distribution. As shown, the best results are obtained with between about 30% and about 50% the catalyst in the first reactor (R1), especially with between about 35% and 40% of the catalyst in the first reactor.

EXAMPLE 12

For the same scheme as illustrated in FIG. 12, this example was run to demonstrate the advantageous hydrogen-containing gas distribution in accordance with the present invention. In this example, hyrodesulfurization catalyst distribution was fixed between the first reactor (R1) and second reactor (R2) at 50% in the first reactor, and the amount of hydrogen fed to the first reactor was varied between 50% and 95% by volume. No recycle stream to the first reactor was used. All other parameters were fixed as set forth in Table 6 below.

TABLE 6

| | |
|---|---|
| Temperature (inlet) | 650° F. |
| Pressure | 600 psi |
| Diameter of each reactor | 10 ft |
| Length of reactor R1 | 20 ft |
| Length of reactor R2 | 20 ft |
| Total volume of catalyst | 3142 $ft^3$ |
| Total hydrogen flow rate | 1200 kmol/h |
| Feedstock | 32000 b/d |
| Space velocity | 2.4 $h^{-1}$ |
| Inlet $H_2$/feedstock | 753 scfb |

Figure 15:
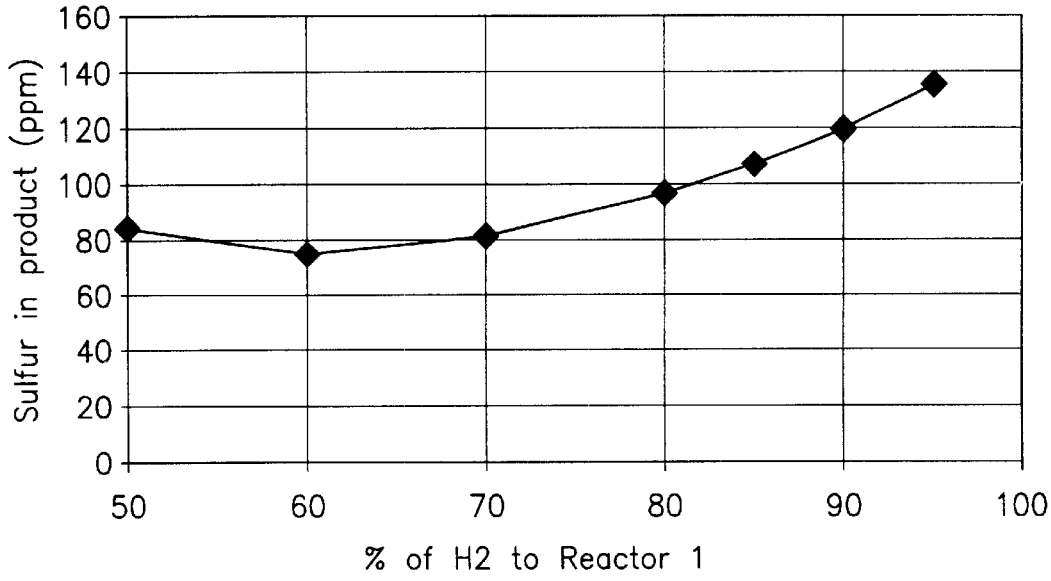
FIG. 15 graphically illustrates sulfur content in the final product as a function of the percentage of total hydrogen-containing gas feed to a first reactor.

FIG. 15 sets forth the relationship between final sulfur content in ppm for the different hydrogen gas distribution to the first reactor. As shown, the best results for this case were obtained with hydrogen feed to the first reactor of about 60% volume, and particularly desirable results were obtained using a hydrogen feed to the first reactor of between about 50% and about 70% of the total volume feed.

EXAMPLE 13

In this example, a two-reactor system as illustrated in FIG. 12 was evaluated with the same catalyst at fixed catalyst distribution (50%–50%), and fixed total hydrogen flow distribution over the two reactors, while all other parameters of interest were fixed as set forth in Table 7 below.

TABLE 7

| | |
|---|---|
| Temperature (inlet) | 650° F. |
| Pressure | 600 psi |
| Diameter of each reactor | 10 ft |
| % of catalyst in Reactor R1 | 50% |
| Hydrogen flow rate to R1 | 1000 kmol/h |
| Hydrogen flow rate to R2 | 350 kmol/h |
| Feedstock | 32,000 b/d |
| Space velocity | 1.3–3.4 $h^{-1}$ |
| Inlet $H_2$/feedstock | 847 scfb |

Figure 16:
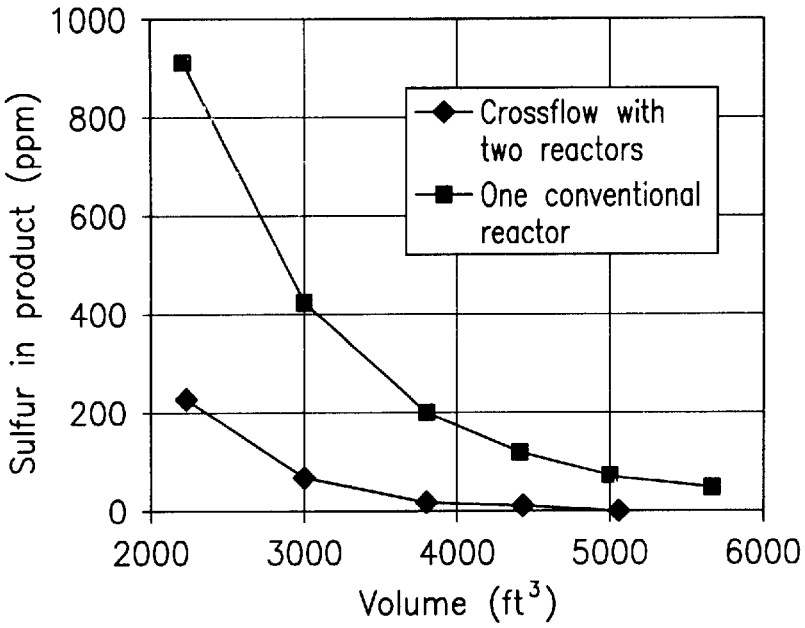
FIG. 16 graphically illustrates sulfur content in the final product as a function of total reactor volume for a multiple-reactor system and method in accordance with the present invention and a conventional single-reactor system.

For comparison purposes, the same amounts of catalyst and hydrogen were used in a single-reactor scheme, and the cross flow and conventional schemes were used at varied amounts of total catalyst volume. The catalyst volume was varied between 2,200 $ft^3$ and 5,800 $ft^3$, and final sulfur content was measured. FIG. 16 shows results in terms of final sulfur content for the cross flow system in accordance with the present invention as compared to the equivalent-volume conventional reactor, and shows dramatically improved results using the cross flow system of the present invention.

EXAMPLE 14

In this example, a two-reactor cross flow scheme as illustrated in FIG. 12 was evaluated using three different total reactor lengths so as to evaluate the process at three different space velocities. For each space velocity, with the same catalyst, distribution of hydrogen and catalyst was varied so as to demonstrate the preferred distributions in accordance with the present invention.

The fixed parameters for this example are as set forth in Table 8 below.

TABLE 8

| | |
|---|---|
| Temperature (inlet) | 650° F. |
| Pressure | 600 psi |
| Diameter of each reactor | 10 ft |
| Total hydrogen flow rate | 1120 kmol/h (700 scfb) |
| Feedstock rate | 32,000 b/d |

The values of space velocity and total reactor length/total catalyst volume which establish same are set forth in Table 9 below.

TABLE 9

| LHSV ($h^{-1}$) | Total reactor length (ft) | Total catalyst volume ($ft^3$) |
|---|---|---|
| 1.9 | 50.2 | 3943 |
| 2.1 | 45.4 | 3566 |
| 2.5 | 38.1 | 2992 |

Table 10 below sets forth the best results obtained for each space velocity and the hydrogen and catalyst distributions which provided same.

TABLE 10

| LHSV ($h^{-1}$) | S in product (wppm) | $H_2$ to R1 (%) | $H_2$ to R2 (%) | Catalyst in R1 (%) | Catalyst in R2 (%) |
|---|---|---|---|---|---|
| 1.9 | 5.5 | 89.8 | 10.2 | 40.8 | 59.2 |
| 2.1 | 11.9 | 90.0 | 10.0 | 40.9 | 59.1 |
| 2.5 | 36.1 | 91.0 | 9.0 | 39.8 | 60.2 |

Figure 17:
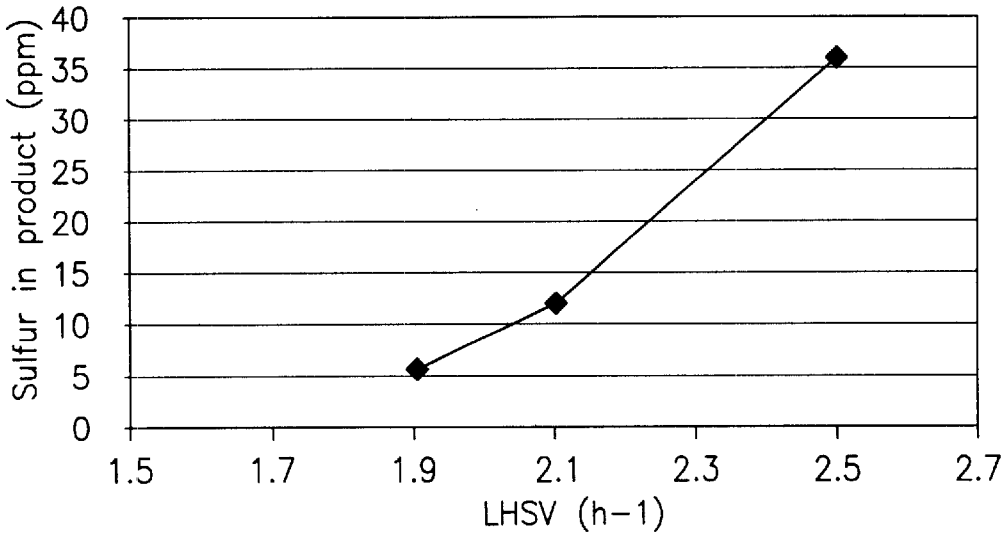
FIG. 17 graphically illustrates final sulfur content as a function of space velocity (LHSV) for a system and method in accordance with the present invention.

FIG. 17 also sets forth the final sulfur content for each space velocity. Furthermore, for comparison purposes, a conventional system using a single reactor was operated at each of the same space velocities and using the same total volume of catalyst and hydrogen flow, and final sulfur content (wppm) was determined. Table 11 below sets forth the results along with the results as illustrated in FIG. 17 for comparison purposes.

TABLE 11

| LHSV ($h^{-1}$) | S in product (wppm) Crossflow | S in product (wppm) "conventional" |
|---|---|---|
| 1.9 | 5.5 | 133 |
| 2.1 | 11.9 | 188 |
| 2.5 | 36.1 | 323 |

As shown, the process of the present invention provided for significantly improved results as compared to conventional single-reactor processes.

EXAMPLE 15

This example demonstrates the advantageous results obtained using a system in accordance with the present invention having three reactors in a cross flow arrangement as illustrated in FIG. 13, with the same catalyst. The feedstock for this example contained a higher initial content of sulfur (1.1% wt). The total hydrogen rate for this example was fixed, and three runs were made varying the total reactor length so as to vary the total catalyst volume and evaluate three different space velocities. The feedstock had a composition as set forth in Table 12 below.

TABLE 12

| | |
|---|---|
| API gravity | 27 |
| Sulfur | 1.1 wt % |
| Aromatics | 31.9 wt % |
| Distillation ASTM D2887 (% V, ° F.) | (IBP,351)/(5,408)/(10,439)/(20,482)/(30,514)/(40,538)/(50,561)/(70,613)/(80,642)/(90,675)/(95,700)/(FBP,750) |

The fixed parameters for this example are set forth in Table 13 below.

TABLE 13

| | |
|---|---|
| Temperature (inlet) | 650° F. |
| Pressure | 515 psia |
| Diameter of each reactor | 9.85 ft |
| Total hydrogen flow rate | 27,890 SCFM (= 2000 kmol/h) (= 1147 scfb) |
| Feedstock rate | 35,000 b/d |

The resulting space values and reactor lengths and catalyst volumes are shown in Table 14 below.

TABLE 14

| LHSV ($h^{-1}$) | Total reactor length (ft) | Total catalyst volume ($ft^3$) |
|---|---|---|
| 1.0 | 107.6 | 8190 |
| 1.5 | 71.9 | 5467 |
| 2.0 | 53.8 | 4679 |

For each velocity, different distributions of hydrogen and catalyst were performed so as to evaluate the best reduction in sulfur content in the final product. The results are set forth in Table 15 below.

TABLE 15

| LHSV ($h^{-1}$) | S in product (wppm) | $H_2$ to R1 (%) | $H_2$ to R2 (=$H_2$ to R3) (%) | Catalyst in R1 (%) | Catalyst in R2 (=catalyst in R3) (%) |
|---|---|---|---|---|---|
| 1.0 | 2.2 | 65.22 | 17.39 | 36.29 | 31.85 |
| 1.5 | 41.1 | 60.07 | 19.97 | 35.21 | 32.40 |
| 2.0 | 147.9 | 58.05 | 20.98 | 34.08 | 32.96 |

Figure 18:
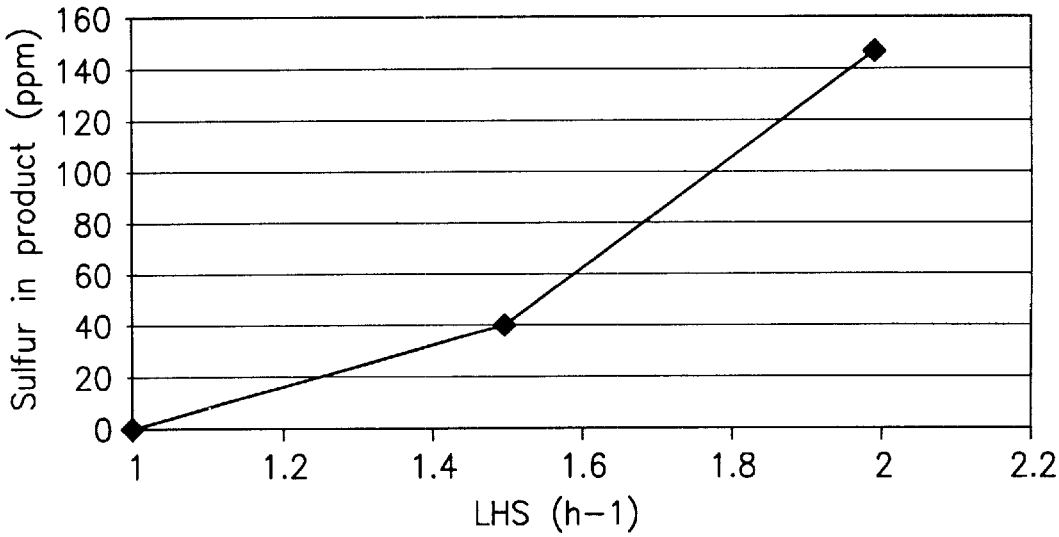
FIG. 18 graphically illustrates final sulfur content as a function of LHSV for a 3-reactor system in accordance with the present invention.

FIG. 18 shows the results in terms of sulfur content in the final product as a function of space velocity, and Table 19 below sets forth a comparison of these results to results obtained utilizing a conventional single-reactor scheme wherein the reactor had the same total volume, contained the same total amount and type of catalyst, and was fed with the same total flow rate of gas.

TABLE 16

| LHSV ($h^{-1}$) | S in product (ppm) Crossflow | S in product (ppm) "conventional" |
|---|---|---|
| 1.0 | 2.2 | 157 |
| 1.5 | 41.1 | 472 |
| 2.0 | 147.9 | 884 |

As shown, the cross flow process of the present invention provided substantially improved results at the same space velocity as compared to conventional single-reactor processes. The process of the present invention could advantageously be used, as shown, to provide dramatically reduced sulfur content (2.2 ppm) in the final product at the same 1.0 LHSV, or could be used to double the space velocity and provide the same final sulfur content as provided using conventional reactors. Either operation represents a substantial improvement obtained using the cross flow process in accordance with the present invention.

In accordance with the foregoing, it should be readily apparent that the process and system of the present invention provide for substantial improvement in hydrodesulfurization processes which can be utilized to reduce sulfur content in hydrocarbon feeds with reactor volume substantially the same as conventional ones, or to substantially increase reactor capacity from the same reactor volume at substantially the same sulfur content as can be accomplished utilizing conventional processes.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for hydrodesulfurization a hydrocarbon feed with a flow rate of hydrogen-containing gas and a volume of catalyst to produce a product having a reduced content of sulfur comprising the steps of:

providing a hydrocarbon feed;

feeding said hydrocarbon feed and a first portion of said flow rate of hydrogen-containing gas cocurrently to a first hydrodesulfurization zone containing a first portion of said catalyst so as to provide a first hydrocarbon product;

providing an additional hydrodesulfurization zone containing a remainder of said catalyst;

feeding said first hydrocarbon product cocurrently with a remainder of said flow rate of hydrogen-containing gas to said additional hydrodelsulfurization zone so as to provide a final hydrocarbon product, wherein said first portion of said hydrogen-containing gas is between about 50 and about 70% vol. of said flow rate of said hydrogen-containing gas, and said first portion of said catalyst is between about 30 and about 50% wt. of said volume of catalyst.

2. The process according to claim 1, wherein said final sulfur content is less than or equal to about 50 wppm based upon weight of said final product.

3. The process according to claim 1, wherein said final sulfur content is less than or equal to about 10 wppm.

4. The process according to claim 1, wherein said first hydrodesulfurization zone and said additional hydrodesulfurization zone each produce a gas phase containing hydrogen sulfide, hydrogen and volatile hydrocarbon fractions and further comprising feeding said gas phase to a low temperature separator for separating a liquid phase containing said volatile hydrocarbon fractions and a gas phase containing said hydrogen sulfide and hydrogen, and combining said volatile hydrocarbon fractions with said hydrocarbon feed.

5. The process according to claim 1, wherein said hydrocarbon feed is a Diesel feed.

6. The process according to claim 1, wherein said hydrocarbon feed is a gasoil feed.

7. The process according to claim 1, wherein said hydrocarbon feed is a mixture of naphtha and diesel feed.

8. The process according to claim 1, wherein said hydrocarbon feed is a mixture of diesel and gasoil feed.

9. The process according to claim 1, wherein said hydrocarbon feed is a naphtha feed, and further comprising feeding a product of said first hydrodesulfurization zone and said additional hydrodesulfurization zone to a condenser for providing liquid phase naphtha and gas phase hydrogen and hydrogen sulfide.

10. The process according to claim 1, wherein said additional hydrodesulfurization zone comprises a plurality of hydrodesulfurization zones, and wherein said remainder of said catalyst and said remainder of said hydrogen-containing gas are distributed between said plurality of hydrosulfurization zones.

11. The process according to claim 10, wherein said plurality of hydrodesulfurization zones are connected serially to sequentially receive said first hydrocarbon product cocurrently with a portion of said remainder of said hydrogen-containing gas.

12. The process according to claim 1, wherein said first portion of said catalyst is between about 35 and about 40% wt. of said volume of catalyst.

* * * * *